US005910269A

United States Patent [19]

Ono et al.

[11] Patent Number: 5,910,269

[45] Date of Patent: Jun. 8, 1999

[54] ELECTRORHEOLOGICAL FLUID COMPOSITION INCLUDING HYDROCARBON COMPOUND HAVING AT LEAST ONE UNSATURATED BOND

[75] Inventors: Satoru Ono, Tsuchiura; Ryuji Aizawa, Toride; Yoshinobu Asako, Tsuchiura, all of Japan

[73] Assignee: Nippon Shokubai Co., Ltd., Osaka, Japan

[21] Appl. No.: 08/858,459

[22] Filed: May 19, 1997

Related U.S. Application Data

[63] Continuation of application No. 08/326,494, Oct. 20, 1994, abandoned.

[51] Int. Cl.[6] ..... C10M 169/04; C10M 171/00

[52] U.S. Cl. ..... 252/73; 252/78.3; 252/572

[58] Field of Search ..... 252/73, 74, 572, 252/78.3

[56] References Cited

U.S. PATENT DOCUMENTS

| | | | |
|---|---|---|---|
| 4,992,192 | 2/1991 | Ahmed | 252/73 |
| 5,032,307 | 7/1991 | Carlson | 252/73 |
| 5,266,229 | 11/1993 | Tomizawa et al. | 252/73 |
| 5,279,754 | 1/1994 | Eusebi et al. | 252/75 |
| 5,326,489 | 7/1994 | Asako et al. | 252/78.1 |

FOREIGN PATENT DOCUMENTS

| | | |
|---|---|---|
| 0361931 | 4/1990 | European Pat. Off. . |
| 51-104598 | 9/1976 | Japan . |

*Primary Examiner*—Christine Skane
*Attorney, Agent, or Firm*—Kubovcik & Kubovcik

[57] ABSTRACT

An electrorheological fluid composition is composed of a dispersed phase of dielectric solid particles and a dispersion medium of an electrically insulating solution, wherein the solution is composed of 99–75% by weight of silicone oil and 1–25% by weight of an organic compound having at least one unsaturated bond. The composition generates a large shear stress even under an electric field of relatively low intensity, and the concurrent current density is small. The composition shows excellent performances also in terms of its withstanding dielectric breakdown strength under an electric field of high intensity and the fluidity and re-dispersibility in the absence of an electric field. In the meantime, the composition has high durability of the generated shear stress and the current density.

18 Claims, 1 Drawing Sheet

ELECTRORHEOLOGICAL FLUID COMPOSITION INCLUDING HYDROCARBON COMPOUND HAVING AT LEAST ONE UNSATURATED BOND

This application is a continuation of application Ser. No. 08/326,494, filed Oct. 20, 1994, now abandoned.

FIELD OF THE INVENTION

The present invention relates to an electrorheological fluid composition which generates a large shear stress under an applied electric field.

BACKGROUND OF THE INVENTION

An electrorheological fluid is known as a fluid which is obtained by dispersing dispersed phase particles in a dispersion medium composed of an electrically insulating solution, and which has a rheological characteristic that changes from the Newtonian viscosity to the Bingham viscosity under an externally applied electric field. It is also generally known that an electrorheological fluid composition shows a so-called Winslow's effect that the viscosity thereof greatly increases and a large shear stress is induced under an externally applied electric field.

Since the Winslow's effect has a characteristic that it shows a shear stress which quickly changes in response to an externally applied electric field, the electrorheological fluid can be applied to a variety of driving devices such as a clutch, a brake, an engine mount, a damper, a valve, a shock absorber, an actuator, an inkjet using an electrorheological fluid, etc.

Examples of conventional electrorheological fluids include those obtained by dispersing dispersed phase particles such as cellulose, starch, silica gel, ion exchange resin, zeolite, etc., into an electrically insulating solution such as silicone oil, diphenyl chloride, transformer oil, etc.

However, the described electrorheological fluids present the problem that a great change in the shear stress cannot be achieved and also a desirable durability in response to the above change cannot be achieved. Therefore, in practice, the above listed electrorheological fluids do not show desirable characteristics in practical applications.

Recently, earnest researches have been made in pursuit of the electrorheological fluid that is of use in practical applications. Most researches are related to the dispersed phase particles because it is considered that the dispersed phase particles are the essential component which directly affect the Winslow's effect.

Examples of the electrorheological fluid having a newly proposed dispersed phase particle include: the fluid including a poly(acene-quinone) (see Japanese Unexamined Patent Publication No. 216202/1986 (Tokukaisho 61-216202)); the fluid including composite particles having a three layer structure wherein an electrically conductive thin layer and an insulating thin layer are formed on an organic solid particle in this order (see Japanese Unexamined Patent Publication No. 97694/1988 (Tokukaisho 63-97694)); the fluid including composite particles wherein electrically conductive particles such as carbon black are dispersed in a resin (see Japanese Unexamined Patent Publication No. 236291/1989 (Tokukaihei 1-236291)); the fluid including carbonaceous powders (EP-361106A1)); the fluid including polyaniline (EP-394005); the fluid including zeolite (U.S. Pat. No. 4,744,914); the fluid including a sulfonated polymer particles in which the number of sulfonic acid groups exceed the number of the aromatic rings (U.S. Pat. No. 5,326,489), etc.

Ahmed (U.S. Pat. No. 4,992,192) discloses electrorheological fluids wherein polymer particles modifying its surface are used as dispersed phase particles to be added to a dispersion medium (vehicle). The modified polymer particle is prepared by polymerizing a substantially hydrophilic monomer on a surface of a substantially hydrophobic polymer particle.

The above listed publications include disclosures regarding improvements in the dispersed phase. However, none of them include disclosures regarding the dispersion medium.

In fact, there aren't many disclosures related to the dispersion medium being an essential component of the electrorheological fluid, and most of the publications disclose techniques for preventing the settlement of the dispersed phase particles by making smaller the difference in specific gravity between the dispersion medium and the dispersed phase particles. Examples of electrorheological fluids, including newly proposed dispersion medium include: halogenated compound (w082/04442 and GB2153372), fluorosilicone oil (EP-284268) and phosphazene compounds (see Japanese Laid-Open patent publication No. 139597/1991 (Tokukaihei 3-139597).

The electrorheological fluid composition has not yet been practically applied to a device because it shows low durability of the shear stress and also of the current density, and also because the viscosity in the absence of the electric field is too high, etc.

For the dispersion medium for the electrorheological fluid, silicone oil is generally used because it has a desirable electric insulation, and also because those which have a low viscosity of several tens cP (centi Poise) are obtainable at a low price.

Therefore, the inventors of the present invention examined the electrorheological fluid using silicone oil as a dispersion medium, with respect to the durability of the shear stress generated under an applied electric field and also the durability of the current density, and discovered that sufficient durability of the shear stress and current density cannot be achieved.

SUMMARY OF THE INVENTION

An object of the present invention is to provide an electrorheological fluid composition which (1) generates a large shear stress and a low current density even under an applied electric field of relatively low intensity; (2) shows an excellent withstanding dielectric breakdown strength under an applied electric field of high intensity; (3) shows excellent fluidity and re-dispersibility in the absence of an electric field, and (4) shows high durability with respect to the shear stress and current density.

Another object of the present invention is to provide an electrorheological fluid composition which shows significant improvements of the above-mentioned properties, without creating any damages on the resin or the rubber which constitute each device, and without losing the excellent properties of silicone oil as a dispersion medium such as its fire retardant property, its high flash point, etc.

In order to achieve the above objective, the electrorheological fluid composition in accordance with the present invention comprises a dispersed phase composed of dielectric solid particles and a dispersion medium composed of an electrically insulating solution, wherein the solution is composed of 99–75% by weight of silicone oil and 1–25% by weight of an organic compound having at least one unsaturated bond.

The electrorheological fluid composition of the present invention is prepared from the dielectric solid particles as the dispersed phase and the electrically insulating solution as a dispersion medium by dispersing the dielectric solid particles into the electrically insulating solution. The rheological properties of the electrorheological fluid composition changes from the Newtonian viscosity to the Bingham viscosity.

By employing the above mixture as the electrically insulating solution, the composition prepared from the mixture shows excellent properties in terms of its withstanding dielectric breakdown strength under an applied strong electric field, the fluidity and the re-dispersibility in the absence of the electric field, and durability of the shear stress and the current density.

Here, the excellent fluidity suggests that the viscosity of the fluid in the absence of an electric field is low, and the excellent re-dispersibility suggests that even when the dispersed phase particles in the fluid temporarily settles and the fluid composition becomes inconsistent, the consistent condition of the composition can be restored by applying a simple external force to the fluid.

In the case where silicone oil is used alone as a dispersed medium, the following problems arise: the property of the withstanding dielectric breakdown strength of the resulting composition under an applied strong electric field is lowered, high durability of the shear stress generated under an applied electric field and also of the current density may not be ensured.

In the case where an organic compound including at least one unsaturated bond is used alone as a dispersion medium, the following problems arise: the re-dispersibility of the composition is lowered, the resin or the rubber in a device to which the composition is applied, such as a clutch, etc., may be damaged, and the dispersion medium becomes combustible.

Further, inventors of the present invention discovered that in the state where the electrorheological fluid composition is deaerated in a closed device, the device can be operated smoothly with good reproducibility, and a drop in reproducibility against the repetitive use can be avoided (see Japanese Laid-Open Patent Publication No. 112793/1993 (Tokukaihei 5-112793).

However, the organic compound including an unsaturated bond cannot be deaerated easily because an affinity between oxygen and nitrogen is strong. Therefore, in the case where the organic compound is used alone as the dispersion medium, it is very difficult to deaerate the electrorheological fluid, thereby presenting the problem that the practicability of the resulting composition is lowered when it is applied to the device.

For the silicone oil in the dispersion medium, polyorganosiloxane including a siloxane structure may be used. Examples of applications of such siloxane include: a damping oil, an air insulating oil, an impregnating injection agent, a lubricating oil, ingredients in cosmetics, a parting agent, a dearating agent, etc.

Examples of such silicone oil include: polydimethylsiloxane; polydiethylsiloxane; a partially alkyl group substituted polydimethylsiloxane such as partially octyl substituted polydimethylsiloxane, partially ethyl substituted polydimethylsiloxane; partial aryl group substituted polydimethylsiloxane such as partially phenyl substituted polydimethylsiloxane, etc.; polydi(trifluoromethyl)siloxane; and partially fluorine alkyl group substituted polydimethylsiloxane such as partially trifluoromethyl substituted polydimethylsiloxane, partially pentafluoroethyl substituted polydimethylsiloxane, etc.

Generally, the viscosity of the silicone oil is adjusted by mixing polyorganodimethylsiloxane having different degrees of polymerization and/or polyorganodimethylsiloxanes of different types.

It is preferable that the viscosity of such a silicone oil is in a range of 10–100 cP at room temperature. When the viscosity is below 10 cP, polyorganosiloxane having a low polymerization degree becomes excessive, and the polyorganosiloxane having a low polymerization degree is volatilized at 150° C. Therefore, when such a composition is applied to the device, since many bubbles are formed in a large amount while the device is being operated, the device may be stopped driving. Therefore, the described composition is of poor use in practical applications.

On the other hand, when the viscosity of the silicone oil exceeds 100 cP, the viscosity of the resulting composition becomes too high, and the fluidity of the composition is lowered.

Therefore, a favorable viscosity range of silicone oil is in a range of 15–75 cP. For the polyorganosiloxane, those having a low viscosity (10–20 cP) is obtainable at a low price, and thus polydimethylsiloxane is preferable.

The organic compound having at least one unsaturated bond in the electrorheological fluid is mainly composed of carbon, hydrogen and an oxygen atom, and includes at least one of $sp^2$—$sp^2$ carbon double bond and/or sp—sp carbon triple bond.

The $sp^2$—$sp^2$ carbon double bond includes an aromatic double bond represented by a double bond in benzene or toluene and an alkene double bond represented by a double bond in ethylene, 2-butene or isobutylene.

The sp—sp carbon triple bond includes alkene triple bond represented by a triple bond in acetylene or 2-butyne.

The examples of such organic compounds include: a long alkene chain such as decene, dodecene, hexadecene, etc.; aromatic hydrocarbon such as diphenylmethane, 1,2-diphenylethane, methylbiphenyl, ethylbiphenyl, etc.; a long chain alkyl aromatic hydrocarbon, such as hexylbenzene, octylbenzene, decylbenzene, dodecylbenzene, stearyl benzene, hexylnaphthalene, octylnaphthalene, dodecylnaphthalene, dihexylnaphthalene, dioctylnaphthalene, hexylanthracene, dihexylanthracene, trihexylanthracene, etc.; a long-chain alkene aromatic hydrocarbon such as decenyl benzene, dodecenyl naphthalene; carboxylates having an unsaturated bond in particles, such as decene acid methyl, dodecene acid ethyl, propionic acid dodecene, benzonic acid hexyl, benzonic acid decene, etc.; esters having an unsaturated bond in particles, such as hexylphenyl ester, dodecyl phenyl ester, hexyldodecenyl ester; halogenated hydrocarbons such as chlorobenzene, bromobenzene, chloronaphthalene, etc.; amines having an unsaturated bond in particles such as N-hexylanine having a nitrogen atom in particles, N,N-dihexylanine, stearylamine, etc.; a copolymer having an unsaturated bond in particles, such as polybutadiene, copolymer of styrene and ethylene, copolymer of styrene and propylene. One or two kinds selected from above listed organic compounds may be used.

It is preferable that the organic compound has superior chemical and physical stability. From this point of view, it is preferable that the organic compound is a hydrocarbon compound having at least one unsaturated bond.

Moreover, it is preferable that the organic compound is dissolvable in silicone oil. If the organic compound is not dissolvable in silicone oil, the withstanding dielectric breakdown strength of the electrorheological fluid composition is lowered, and the durability of the generated shear stress and the current density may be lowered. Concerning the above, a long-chain aromatic hydrocarbon is a preferable organic compound.

The ratio of $sp^2$ and/or sp carbon to $sp^3$ carbon in the organic compound is preferably in a range of 4–50 to 100, more preferably in a range of 6–40 to 100. Additionally, $sp^3$ carbon is a carbon which forms a saturated bond, and $sp^2$ and sp carbons are carbons which form an unsaturated bond.

When the ratio of the carbon which forms an unsaturated bond is less than 4, the withstanding dielectric breakdown strength of the electrorheological fluid may be insufficient, or the durability of the shear stress and of the current density may be insufficient. When the ratio of carbon which constitutes an unsaturated bond is above 50, the solubility in silicone oil may be lowered, which gives rise to the problem that it becomes of lowered usability in practical applications.

The organic compound is preferably a liquid in a range of 5–100 cP at 25° C. When the viscosity of the organic compound is below 5 cP, the device in which the above composition is applied, air bubbles may be formed while being used as the organic compound is volatilized, and the device may be damaged. On the other hand, when the viscosity of the organic compound is above 100 cP, the organic compound may not be dissolved in silicone oil.

It is preferable that the boiling point of the above organic compound is above 150° C. When the above boiling point is below 150° C., air bubbles may be formed as the organic compound is volatilized while being used, and the device may not function properly.

The ratio of the silicone oil to the organic compound in the electrically insulating solution is required to be at least 99–75% by weight to 1–25% by weight, favorably 97–80% by weight to 3–20% by weight, and preferably 95–85% by weight to 5–15% by weight.

When the content of the organic compound is less than 1% by weight, the problems are presented in that the withstanding dielectric breakdown strength under an applied electric field of high intensity is lowered, or durability of an induced shear stress and of the current density is lowered.

When the content of the organic compound to the electrically insulating solution exceeds 25% by weight, the problems that the composition obtained from the electrorheological fluid involve poor re-dispersibility, and the resin or the rubber of the device in which the electrorheological fluid composition is applied deteriorate, and further, the electrorheological fluid composition becomes combustible.

On the other hand, when the organic compound content is below 3% by weight, the electrorheological fluid composition may not show sufficient durability of the shear stress and of the current density.

On the other hand, when the organic compound content exceeds 15% by weight, it becomes more difficult to deaerate the resulting electrorheological fluid composition. Therefore, air bubbles are likely to remain in the resulting composition, and when the composition is applied to a closed device, the problems arise in that the device may not function well, and the reproducibility of the device may be lowered.

Other than silicone oil and the organic compound, the electrically insulating solution may be mixed with a dispersion medium additive. By mixing the additive, the silicone oil and the organic compound can be well mixed, and the content of the additive to the electrically insulating solution is preferably below 24% by weight.

Examples of such additives include: saturated aliphatic hydrocarbon such as dodecane, octadecane, liquid paraffin, etc.; alcohol such as stearyl alcohol, dodecanol, etc.; and polyalkylene glycol such as ethylene glycol, propylene glycol, etc.

The viscosity of the described electrically insulating solution at 25° C. is preferably in the range of 10–100 cP. When the viscosity of such a mixed solution is below 10 cP, the dielectric solid particles contained in the resulting composition are likely to settle, thereby presenting the problem that the dispersibility of the particles is lowered. On the other hand, when the viscosity of the mixed solution exceeds 100 cP, a desirable fluidity of the resulting composition may not be ensured.

Additionally, an oxidant inhibitor, a corrosion inhibitor, a pour point depressant, etc., may be added to the electrically insulating solution if necessary.

The described dielectric solid particles are the essential component which directly affects the electrorheological effect that the electrorheological fluid changes from the Newtonian viscosity to Bingham viscosity in the presence of electric field. When an external electric field is applied to a suspension wherein the particles are dispersed in an electrically insulating solution at the density of about 1% by weight, the particles form a bridge structure between electrodes.

Examples of dielectric particles include: organic solid particles having an ionic dissociation group, such as starch, cellulose, ion exchange resin, sulfonated polymer particles in which the number of sulfonic acid groups exceed the number of the aromatic rings, etc.; an inorganic solid particle having an ionic dissociation group such as silica, alumina, etc.; a composite particle such as a particle of a three layer structure wherein an electrically conductive thin film layer is formed on a surface of the particle around an organic solid particle, and further an electrically insulating thin film is formed, a particle wherein an electrically insulating thin film is formed on the surface of the electrically conductive particle such as an aluminum, etc., a particle wherein an electrically conductive particle such as a carbon black, etc., is dispersed in a resin, etc.; a semiconductor particle such as poly(acene-quinone), polyaniline, carbonaceous powders, etc., and a ferroelectric particle such as zeolite, barium titanate, lithium tartrate, etc.

Among the above listed dielectric particles, the solid particle having an ionic dissociation group, a semiconductor particle, and the composite particle including an electrically insulating layer on a surface of the electrically conductive particle are preferable because they show a great electrorheological effect. Additionally, among the solid particles including an ionic dissociation group, the solid particle including a sulfonic acid is preferable because it has high durability of the shear stress and of the current density.

The dielectric solid particles are preferably spherical or ellipsoidal in shape to achieve a high durability. When the dielectric solid particles are not spherical nor ellipsoidal in shape, the properties of the composition may be of low quality in terms of durability of the generated shear stress and of the current density.

The average particle diameter of the dielectric solid particle is preferably in a range of 0.05–100 micron. When the average particle diameter is below 0.05 micron, a large shear stress may not be achieved when an electric field is applied to the obtained composition. On the other hand, when the average particle diameter is above 100 micron, the shear stress becomes unstable when a constant electric field is applied to the prepared composition.

The electrorheological fluid composition of the present invention is obtained by dispersing the dielectric solid particle in the electrically insulating solution. The ratio of the dielectric solid particle to the electrically insulating solution in the composition is 100 parts by weight to 50–500 parts by weight. When the ratio of the electrically insulating solution is above 500 parts by weight, a sufficiently large shear stress under an applied electric field may not be achieved. On the other hand, when the content of the electrically insulating solution is below 50 parts by weight, the fluidity of the prepared composition is lowered, and thus the practicality of the electrorheological fluid is lowered.

On the other hand, when the viscosity of the composition measured at 25° C. and at a shear rate of 33/s is preferably below 500 cP. When the viscosity is above 500 cP, the fluidity of the composition is low, and the application of the electrorheological fluid composition to the device is limited.

Further, it is preferable that the electrorheological fluid composition has a structural viscosity which satisfies the following formula:

$$10\ \text{cP} \leqq \eta_1 - \eta_2 \leqq 500\ \text{cP} \quad (1)$$

In formula (1), $\eta_1$ represents a viscosity measured at 25° C. and a shear rate of 3.3/s in the absence of an electric field, $\eta_2$ represents a viscosity measured at 25° C. and a shear rate of 33/s in the absence of an electric field. Hereinafter, $(\eta_1-\eta_2)$ is shown by Ti.

The electrorheological fluid composition which satisfies the above condition exhibits an excellent dispersion stability, re-dispersibility and fluidity all at the same time. More specifically, the dispersion stability indicates that without causing the dispersed phase particles in the composition to settle nor float, the quality of the composition can be maintained for a long period of time.

The structural viscosity is generated by a structure composed of dispersed phase particles and the dispersion medium, by a weak agglomeration between dispersed phase particles in the dispersion medium. The structural viscosity is controlled by an interaction between dispersed phase particles, and desirable dispersion stability and the re-dispersibility of the electrorheological fluid composition can be achieved.

In order to practically apply the composition having the structural viscosity to devices, the composition preferably has a viscosity of not more than 500 cP at 25° C. and a shear rate of 33/s in the absence of an electric field, more preferably 200 cP, and most preferably shows a viscosity in a range of 10–100 cP.

When the viscosity exceeds 500 cP, the fluidity of the resulting composition is lowered, and a sufficient electrorheological effect cannot be achieved. When the composition having the viscosity over 500 cP is applied to the device, a problem in designing the device arises because the degree of freedom in designing the device is limited.

As shown in the formula (1), the value Ti is preferably set in a range of 10–500 cP, and more preferably in a range of 50–100 cP. When the value Ti is in the above range, the resulting electrorheological fluid composition exhibits still improved dispersion stability, re-dispersibility and fluidity. However, when the value Ti is below 10 cP, the structural viscosity is insufficient, and the dispersion stability also becomes insufficient. On the other hand, when the value Ti exceeds 500 cP, the fluidity in the absence of an electric field also becomes insufficient.

The electrorheological fluid composition showing the structural viscosity has sufficient dispersion stability, and the stable dispersion can be maintained while being gently stirred and in the static state, and thus it can be effectively applied to various types of devices.

A technique for applying the structural viscosity represented by a specific formula while maintaining a specific viscosity to the electrorheological fluid composition is not specified. However, it is effective to use an addition agent or to apply a treatment on the surface of the solid particle of the dispersed phase with a polymer.

It is preferable that an addition agent is added to the dispersed phase composed of dielectric solid particles and to a dispersion medium composed of an electrically insulating solution in terms of dispersion stability and the re-dispersibility of the electrorheological fluid composition, and convenience in preparing the composition.

Especially, with an appropriate selection of the addition agent, excellent dispersion stability can be easily applied to the composition while maintaining the shear stress induced under an applied electric field.

Desirable addition agents include:

(i) those which are particulate in the electrorheological fluid composition, and satisfy the following formula (2)

$$3/10 < XB/XA < 3 \quad (2),$$

wherein XB represents the average particle diameter of the addition agent, and XA represents an average particle diameter of the dielectric solid particles; and (ii) those which are substantially insoluble in the electrically insulating solution, and have a unit structure (A) including a silicone component and a unit structure (B) including an adhesive chain to the dielectric solid particles.

With a selection of the addition agent (i) which is particulate with the specific average particle diameter, a well balanced electrorheological fluid composition can be achieved by applying the structural viscosity represented by the specific formula while maintaining the specific viscosity without lowering the shear stress below the required shear stress for devices.

The average particle diameter XA of the solid particle and the average particle diameter XB of the addition agent (i) respectively represent the average particle diameters in the state where the solid particle and the addition agent (i) are dispersed in the electrically insulating solution required for the preparation of the electrorheological fluid composition. For example, the average particle diameter XB of the addition agent (i) can be measured when the addition agent (i) is dispersed in silicone oil using a particle size analyzer.

In the above formula (2), when XB/XA is below 3/10, although the structural viscosity can be achieved, the induced shear stress cannot be large.

On the other hand, when XB/XA is above 3, the desirable structural viscosity cannot be ensured.

The addition agents (i) are not specified as long as they are particulate in the electrically insulating solution, and examples of such addition agents include: an organic particle such as polystyrene, polymethacrylate, polyacrylonitrile, phenolic resin, benzoguanamine resin, melanin resin, etc.; an inorganic particle such as silica, alumina, etc.; and a composite particle wherein a high polymer is formed on a surface of the above organic particle or inorganic particle.

When an addition agent (ii) is used, since it adheres to the surface of the dispersed phase particle, an interaction occurs between the addition agent (ii) and the surface of the dispersed phase particle. Additionally, since the addition agent (ii) has an affinity with the dispersion medium, an interaction also occurs between the addition agent (ii) and the dispersion medium. As a result,a specific structure composed of the dispersion phase particles, the dispersion medium and the addition agent (ii) is formed. Here, since the additive (ii) is substantially insoluble in the dispersion medium, a contact between particles of the dispersed phase can be avoided.

With a selection of the described addition agent (ii), the structural viscosity represented by the above formula can be applied while maintaining the specific viscosity. The use of the described addition agent (ii) causes desirable dispersion stability and fluidity at the same time.

Although the addition agent (ii) that is substantially insoluble in the electrically insulating solution is preferable, those including a soluble component may be used as long as the content of the soluble component is below 90% by weight. As long as the addition agent (ii) does not form a uniform solution by being dissolved uniformly, the addition agent (ii) may partially or entirely swell in the solution. If a large amount of soluble component of above 90% by weight is contained, the re-dispersibility of the resulting electrorheological fluid may be lowered.

It is preferable that the addition agent (ii) has a unit structure (A) having a silicone component. If an addition agent does not have the structure unit (A), the dispersion stability and/or fluidity of the resulting electrorheological fluid can be lowered. Here, the silicone component is a polysiloxane group such as polydimethylsiloxane group, partial alkyl group substituted polydimethylsiloxane group, tris(trialkylsiloxy).

It is preferable that the addition agent (ii) has a unit structure (B) having a dispersed phase adhesive chain. If an addition agent does not have the unit structure (B), the dispersion stability of the resulting electrorheological fluid can be lowered. Here, the type of adhesion may be chemical or physical.

However, if the interaction between the agent (ii) and the surface of the dispersed phase particle is too strong, the re-dispersibility and the fluidity of the resulting composition may be lowered. In this regard, the type of adhesion is preferably physical adhesion or static electric chemical adhesion. The dispersed phase adhesive chain suggests, for example, functional groups that can be hydrocarbon groups or Lewis base groups containing a nitrogen atom or an oxygen atom.

Examples of the addition agents (ii) to be mixed in the resulting electrorheological fluid composition, which can give the structural viscosity represented by a specific formula while maintaining a specific viscosity are a composite of substantially insoluble particles (I) and a copolymer including a polysiloxane (II).

The copolymer (II) has the structure unit (A). The structure unit (A) including a silicone component may be the structure unit (A-1) represented by, for example, chemical formula (3).

(3)

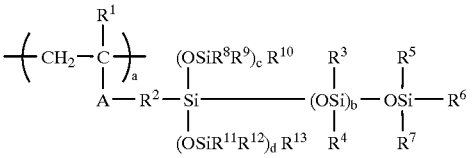

In the formula (3), A represents —COO— or phenylene group, $R^1$ represents a hydrogen atom or a methyl group, $R^2$ represents an alkylene group having an atomic number of 1–6, $R^3$–$R^{13}$ can be the same or different aryl groups, an alkyl group having an atomic number of 1–6, or an alkoxyl group having an atomic number of 1–10, a represents a randomly selected integer, a and b can be the same or different integers selected from 0–10 and d represents an integer selected from 0–200.

As a structure unit (B) having a dispersed phase adhesive chain, a structure unit (B-1) having an alkylene oxide chain represented by the following general formula (4) may be used.

(4)

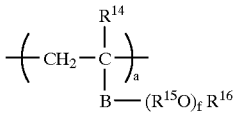

In the above chemical formula (4), B represents —COO— or phenylene group, $R^{14}$ represents a hydrogen atom or a methyl group, $R^{15}$ represents an alkylene group having an atomic number of 2–4, $R^{16}$ represents a hydrogen atom or an alkylene group, e represents an randomly selected integer, and f represents an integer selected from 2–100.

The unit structure (B) having the described dispersed phase adhesive chain may be a unit structure (B-2) having a nitrogen atomic chain represented by the following formula (5).

(5)

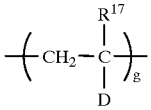

In the above formula (5), D is either represented by the following formula:

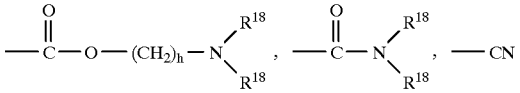

or a functional group having a nitrogen-heterocycle, $R^{17}$ represents a hydrogen atom or a methyl atom, $R^{18}$ represents a hydrogen atom or an alkyl group, g represents a randomly selected integer and h represents an integer selected from 2–6.

The unit structure (B) having the dispersed phase adhesive chain may be the unit structure (B-3) including a hydrocarbon group represented by the following general formula (6).

(6)

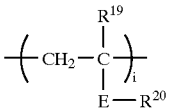

In the formula (6), E represents —COO— or phenylene group, $R^{19}$ represents a hydrogen atom or a methyl group, $R^{20}$ represents an alkyl group having an atomic number selected from 1–30, and i represents a randomly selected integer.

The composite is preferably included in a proportion of 0.01–6 parts by weight per 100 parts by weight of the dielectric solid particle. When the amount of composite is below 0.01 parts by weight, the resulting electrorheological composition does not show the structural viscosity, and a dispersion stability cannot be achieved. On the other hand, when more than 6 parts per weight of a composite is added, the re-dispersibility and the fluidity of the composition are greatly lowered. The content of the composite is more preferably in the range of 0.1–5 parts by weight.

The composite is preferably obtained by complexing the particles (I) that are substantially insoluble in the electrorheological fluid and the copolymer (II) including polysiloxane having the unit structure (A-1) including polysiloxane and the unit structure (B) having a dispersed phase adhesive chain.

The unit structure (B) may be a unit selected from the group consisting of the unit structure (B-1) including an alkylene oxide chain, the unit structure (B-2) including a nitrogen atom and the unit structure (B-3) including hydrocarbon.

The use of the composite offers an interaction between the dispersed phase particles and the dispersed medium, and the dispersion stability, the re-dispersibility and fluidity of the electrorheological fluid composition can be achieved.

Moreover, since the compound includes particles (I) which are substantially insoluble, the composite itself is also insoluble to the solution. Namely, as the composite is substantially insoluble to the dispersion medium, contact between dispersed particles can be avoided in the electrorheological fluid. When the composite is substantially soluble in the electrorheological fluid composition, the re-dispersibility and the fluidity may not be achieved in the resulting electrorheological fluids.

The particles (I) are not specified as long as they are substantially insoluble in the electrically insulating solution, and examples of such particles (I) include: an organic particle such as polystyrene, poly(meth)acrylate, polyacrylonitrile, phenolic resin, benzoguanamine resin, melanin resin; an inorganic particle such silica, alumina, etc., an improved particle wherein reactive groups such as amino group, carboxyl group, epoxy group, isocyanate group, styryl group, (meth)acryloyl group, etc. is introduced in the surface of the above organic particle or inorganic particle.

The composite includes the copolymer (II) including polysiloxane having the unit structure (A-1) and the unit structure (B) having the dispersed phase adhesive chain.

With the structure unit (A-1) of the composite, an appropriate interaction is exerted between the composite and the dispersion medium, and the dispersion stability and the fluidity can be applied to the electrorheological fluid composition.

With the unit structure (B) in the composite, an appropriate interaction is exerted between the composite and the dispersed phase particle, an appropriate dispersion stability can be applied to the electrorheological fluid composition. In the composite, when the unit structure (B) is not included, the dispersion stability of the composition is lowered.

In the composite, the ratio of the copolymer (II) to the particle (I) is preferably in the range of 0.1–100 parts by weight to 100 parts by weight. When the content of the latter is less than 0.1 parts by weight, an appropriate dispersion stability cannot be applied to the electrorheological fluid composition. On the other hand, when the content of the latter exceeds 100 parts by weight, the re-dispersibility and the fluidity may not be applied to the electrorheological fluid composition.

The composite is composed of the particle (I) and the copolymer (II), and the type of complexing is not specified. However, the composite is preferably obtained by completing the copolymer (II) on the surface of the particle (I). If the copolymer (II) is not complexed on the surface of the particle (I), the dispersion stability may not be applied to the resulting electrorheological fluid composition.

The composite is preferably a composite through chemical bond between the particles (I) and the copolymer (II). By complexing (I) and (II) through the chemical bond, the composite which serves as an appropriate addition agent of the present invention can be easily obtained. When the composite of (I) and (II) is not achieved through the chemical bond, the resulting compound may not be a desirable addition agent in accordance with the present invention.

The method of obtaining the composite by completing (I) and (II) is not limited, and suitable methods include: (i) a method for generating particles (I) in the presence of copolymer (II), and the thereby simultaneously effecting the formation of particle (I) and the complexing, (ii) a copolymer (II) is generated in the presence of the particle (I), thereby simultaneously effecting the formation of particle (I) and the complexing, and a method (iii) the particle (I) and the copolymer (II) are independently synthesized, and after kneading them, both are complexing by heat treatment and radiation treatment.

For a fuller understanding of the nature and advantages of the invention, reference should be made to the ensuing detailed description taken in conjunction with the accompanying drawings.

DESCRIPTION OF THE EMBODIMENTS

Figure 1:
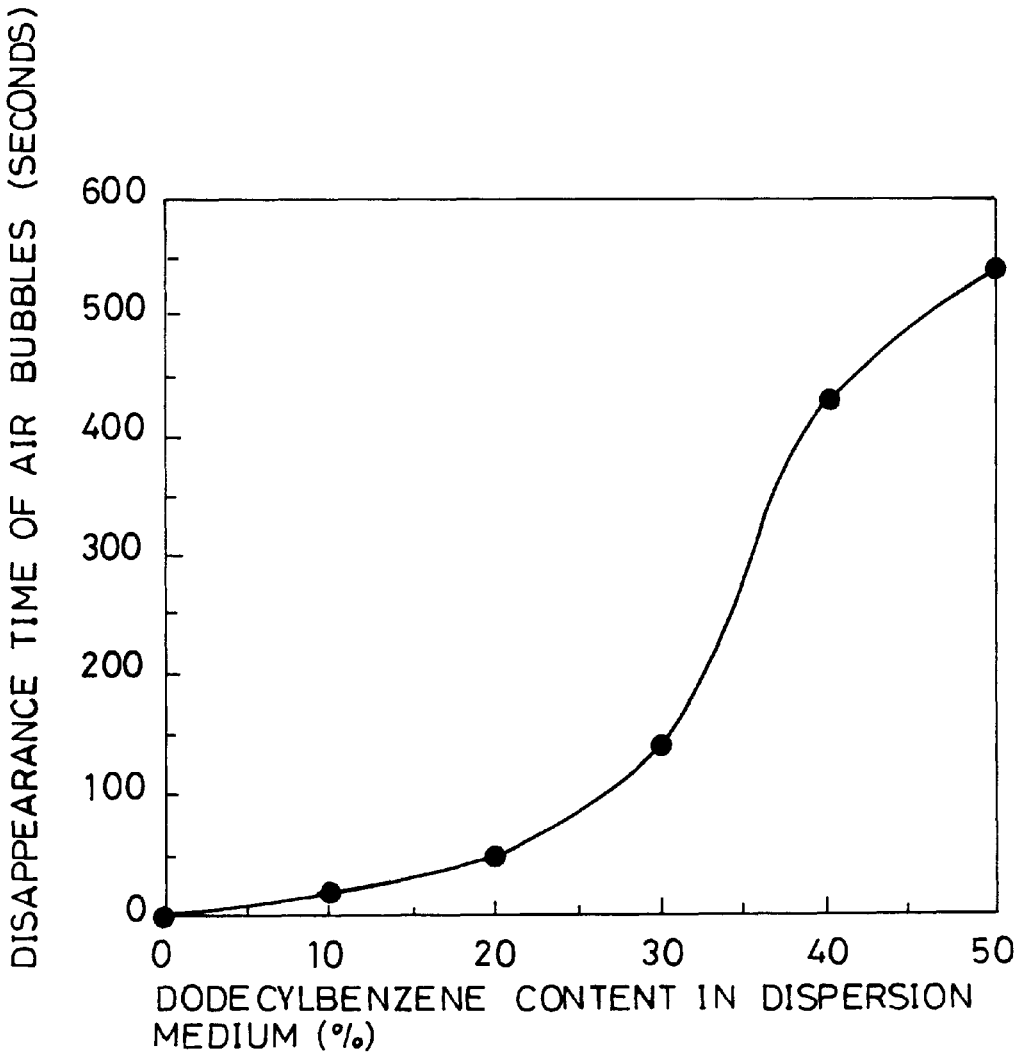
FIG. 1 is a graph showing a relationship between an organic compound content in a dispersion medium of the electrorheological fluid composition and the disappearance time of air bubbles in the composition.

The electrorheological fluid composition in accordance with the present invention was prepared by dispersing solid particles as a dispersed phase in a dispersion medium. The solid particles are dielectric. The dispersion medium includes at least an organic compound that is dissolvable in an electrically insulating solution and an electrically insulating solution.

REFERENCE EXAMPLES

Mixed solutions in accordance with Reference Examples 1–9 as examples of dispersion medium are explained below.

Reference Example 1

A reference mixed solution (1) was prepared by mixing 63 g of dimethylsilicone oil (KF96-20cS available from Shin-etsu Chemical Industry Co., Ltd.) and 7 g of dodecyl benzene. The obtained mixed solution (1) resulted in a viscosity of 18 cP at 25° C. with a shear rate of 33/s. In the subsequent examples also, respective viscosities were measured at 25° C. with a shear rate of 33/s if not specified.

Reference Example 2

A reference mixed solution (2) was prepared by mixing 56 g of dimethylsilicone oil of Reference Example 1 and 14 g of dodecyl benzene. The obtained mixed solution (2) resulted in a viscosity of 17 cP.

Reference Example 3

A reference mixed solution (3) was prepared by mixing 65 g of dimethylsilicone oil (KF96-50cS available from Shin-etsu Chemical Industry Co., Ltd.) and 5 g of p-ethyl biphenyl. The obtained mixed solution (3) resulted in a viscosity of 43 cP.

Reference Example 4

A reference mixed solution (4) was prepared by mixing 40 g of dimethylsilicone oil of Reference Example 1, 23 g of methylphenyl silicone oil (KF54 available from Shin-etsu Chemical Industry Co., Ltd.) and 7 g of 1-dodecene. The obtained mixed solution (4) resulted in a viscosity of 25 cP.

Reference Example 5

A reference mixed solution (5) was prepared by mixing 63 g of dimethylsilicone oil of Reference Example 1, 5 g of dodecyl benzene and 2 g of 1,2-diphenyl ethane. The obtained mixed solution (5) resulted in a viscosity of 18 cP.

Reference Example 6

A reference mixed solution (6) was prepared by mixing 65 g of dimethylsilicone oil of Reference Example 1, and 5 g of polybutene (LV-10 available from Nippon Oil Company Ltd.). The obtained mixed solution (6) resulted in a viscosity of 16 cP.

Reference Example 7

A reference mixed solution (7) was prepared by mixing 65 g of dimethylsilicone oil of Reference Example 1 and 5 g of dodecane. The obtained mixed solution (7) resulted in a viscosity of 18 cP.

Reference Example 8

A reference mixed solution (8) was prepared by mixing 49 g of dimethylsilicone oil of Reference Example 1 and 21 g of dodecyl benzene. The obtained mixed solution (8) resulted in a viscosity of 16 cP.

Reference Example 9

A reference mixed solution (9) was prepared by mixing 35 g of dimethylsilicone oil of Reference Example 1 and 35 g of dodecyl benzene. The obtained mixed solution (9) resulted in a viscosity of 25 cP.

EXAMPLES

The distinctive properties of the electrorheological fluid compositions in accordance with Examples 1–11 of the present invention, in which the dispersion medium of Reference Examples 1–9 are used, are explained below in reference to Comparative Examples 1–9.

Example 1

One example of dielectric solid particles in the electrorheological fluid composition in accordance with the present invention will be explained. A solid particle has an ionic dissociation group in a spherical polymer.

First, the polymer will be explained.

A three-liter separable flask with four openings provided with an agitator, a reflux condenser and a thermometer was prepared. In the flask, 1.2 liters of water were put into the flask, and 8 g of polyvinyl alcohol (POVAL VA-205 available from Kuraray Co., Ltd.). was dispersed therein. Thereafter, a mixture composed of 280 g of styrene, 20 g of industrial divinyl benzene (a mixture of 55% by weight of divinyl benzene and 35% by weight of ethyl styrene, available from Wako Pure Chemical Industry Co., Ltd.), and 5 g of azobisisobutyronitrile were added in the flask.

Controlling a particle diameter by dispersing the content in the flask at a stirring rate of 4000 rpm using a dispersing device, the contents in the flask were polymerized for 8 hours at 80° C. After the reaction had been completed, an obtained solid material was filtered off and dried for 12 hours at 80° C. by a hot air dryer without being washed with water, thereby obtaining 288 g of spherical polymer (hereinafter referred to as a polymer (1)).

Next, a solid particle wherein an ionic dissociation group is formed in the polymer (1) is explained. A five-liter separable flask with four openings provided with an agitator, a thermometer and a dropping funnel was prepared. In the flask, 20 g of polymer (1) was put, and the flask was cooled off to 0° C. in an ice bath.

In the flask, 2500 g of 98% by weight of concentrated sulfuric acid was put, and was heated and stirred for 24 hours at 80° C. Then, a sulfonation reaction was applied to the polymer (1). After the reaction mixture was put in water of 0° C., the mixture was filtered off and washed with water. The resulting solid material was neutralized with 1200 ml of 10% by weight of aqueous sodium hydroxide and washed with water. Next, the solid material was dried for 10 hours at 80° C. by a vacuum dryer, and 330 g of solid particles (1) composed of a spherical sulfonated polymer was obtained.

The diameter of the solid particle (1) was measured by a particle size analyzer, and was found to have an average diameter of of 20 $\mu$m. The ion exchange content of the particle (1) was 4.5 mg eq./g by the neutral titration, and was 4.6 mg eq./g by the elemental analysis. The particle (1) has 2.4% by weight of water content as a result of measurement by a Karl Fischer moisture meter.

30 g of particles (1) were dispersed in 70 g of the mixed solution (1) prepared in Reference Example (1), an electrorheological fluid composition (1) in accordance with the present invention was obtained.

Example 2

30 g of particles (1) were dispersed in 70 g of the mixed solution (2) prepared in Reference Example (2), an electrorheological fluid composition (2) in accordance with the present invention was obtained.

Example 3

30 g of the particles (1) were dispersed in 70 g of mixed solution (3) prepared in Reference Example (3), and an electrorheological fluid composition (3) in accordance with the present invention was obtained.

Example 4

30 g of particles (1) were dispersed in 70 g of mixed solution (4) prepared in Reference Example (4), and an electrorheological fluid composition (4) in accordance with the present invention was obtained.

Example 5

Another example of solid particles in the electrorheological fluid composition in accordance with the present invention is explained. The solid particles were obtained in the following manner. A monomer was polymerized to obtain an spherical copolymer, and from a hydrolytic reaction of the spherical copolymer, the ionic dissociation group resulted.

First, the polymer is explained. 1.2 liters of water were put into the three-liter flask shown in Example 1, and 8 g of polyvinyl alcohol of Example 1 was dispersed therein. Thereafter, in the flask, a mixture of 280 g of ethyl acrylate, 20 g of industrial divinyl benzene of Example 1 and 10 g of benzoyl peroxide was added.

Thereafter, the content in the flask was dispersed by a dispersing device at a stirring rate of 4000 rpm while controlling a particle diameter, and polymerized for 8 hours at 80° C. After the reaction had been completed, the obtained solid material was filtered off and washed well with water. Then, the solid material was dried for 12 hours at 80° C. by a hot air dryer, thereby obtaining 280 g of spherical polymer (hereinafter referred to as a polymer (2)).

Next, the solid particle wherein an ionic dissociation group was formed will be explained. First, 200 g of polymer (2) was put in the five-liter flask of Example 1, and three-liter of ethanol solution wherein 2500 g of sodium hydroxide were dissolved were added, and an uniform dispersion was obtained.

Then, the temperature in the flask was raised to a reflux temperature, and the reaction mixture in the flask was heated to reflux and stirred for six hours, and the hydrolytic reaction was performed. After the reaction mixture was put in water at 0° C., it was filtered off and washed with water. The resulting solid material was dried at 80° C. for ten hours using a vacuum dryer, and 185 g of solid particle (2) composed of spherical sodium polyacrylates was obtained.

The solid particle (2) was measured by a particle size analyzer, and found to have an average particle diameter of 15 μm. The ion exchange content of the particle (2) was 9.8 mg eq./g by the neutral titration, and 9.7 mg eq./g by the elemental analysis. The particle (2) has 7.5% by weight of water content as a result of measurement by a Karl Fischer moisture meter.

30 g of the particle (2) was dispersed in 70 g of mixed solution (5) prepared in Reference Example (5), and an electrorheological fluid composition (5) of the present invention was prepared.

Example 6

Zeolite particles were used as still another example of the solid particles in accordance with the present invention. The solid particles were obtained in the following manner. Zeolite particles (that have an average diameter of 3 μm and is available from Sigma Chemical Company) was dried for three hours at 150° C. Next, the moisture in air was absorbed so that the moisture content becomes 10.0% by weight, and solid particles were obtained (hereinafter referred to as particles (3)).

30 g of particles (3) thus prepared were dispersed in 70 g of mixed solution (6) prepared in Reference Example (6), and an electrorheological fluid composition (6) of the present invention was obtained.

Comparative Example 1

30 g of particles (1) of Example 1 were dispersed in 70 g of dimethyl silicone oil of Reference Example 1, and a reference electrorheological fluid composition (1) was obtained (hereinafter referred to as a reference composition (1)).

Comparative Example 2

30 g of particles (1) of Example 1 were dispersed in 70 g of dimethyl silicone oil of Reference Example 3, and a comparative electrorheological fluid composition (2) was obtained (hereinafter referred to as a reference composition (2)).

Comparative Example 3

30 g of particles (2) of Example 5 were dispersed in 70 g of comparative mixed solution of Reference Example 7, and a comparative electrorheological fluid composition (3) was obtained (hereinafter referred to as a reference composition (3)).

Comparative Example 4

30 g of the particles (1) of Example 1 were dispersed in 70 g of reference mixed solution of Reference Example 8, and a comparative electrorheological fluid composition (4) (hereinafter referred to as a reference composition (4)) was obtained.

Comparative Example 5

30 g of particles (1) of Example 1 were dispersed in 70 g of reference mixed solution of Reference Example 9, and a reference electrorheological fluid composition (5) (hereinafter referred to as a reference composition (5)) was obtained.

Comparative Example 6

30 g of particles (1) of Example 1 were dispersed in 70 g of dodecylbenzene, and a reference electrorheological fluid composition (6) (hereinafter referred to as a reference composition (6)) was obtained.

Next, results of measurements of performances of each composition will be explained.

Regarding example compositions (1)–(6) of Examples 1–6 and reference compositions (1)–(6) of Comparative Examples 1–6, respective viscosities in the absence of an electric field at 25° C. were measured, and the results are as shown in Table 1.

TABLE 1

| | Viscosity (cP) | Redispersibility (times) | Disappearance Time of Bubbles (seconds) |
|---|---|---|---|
| Example Composition | | | |
| (1) | 44 | 70 | 20 |
| (2) | 35 | 79 | 50 |
| (3) | 82 | 65 | 15 |
| (4) | 60 | 84 | 32 |
| (5) | 42 | 70 | 18 |
| (6) | 41 | 66 | 17 |
| Reference Composition | | | |
| (1) | 46 | 60 | 0 |
| (2) | 88 | 70 | 0 |
| (3) | 42 | 63 | 12 |
| (4) | 33 | 95 | 140 |
| (5) | 31 | 110 | 540 |
| (6) | 27 | 120 | 700 |

Re-dispersibility of the above compositions was also measured in the following manner. First, 30 ml of each composition was put into a 50 ml of transparent container, and was left for one month. Thereafter, the container which contains therein the composition was rotated at a rotation speed of 30 times per minute, and the number of rotations required for restoring a uniform state was measured, and each composition was evaluated by the measured number of rotations. The results of the measurements are also shown in Table 1.

Each composition had a low viscosity of less than 100 cP. However, reference compositions (1)–(6) which contain 30% by weight of an organic compound in the dispersion medium, the ability to be dispersed again was lowered with an increase in the organic compound content.

The dearating performances of the compositions were respectively measured. The dearating performances were evaluated by observing a time (seconds) required from the formation of air bubbles in the composition by introducing a nitrogen gas until the disappearance of air bubbles. More concretely, 50 g of of each composition is transferred to a sample tube, and a nitrogen gas was introduced through a needle into the composition at 10 ml/min for five minutes, and bubbles were formed in the composition. Thereafter, the time required for air bubbles to be disappeared was observed, and the dearating performance of each composition was evaluated by the disappearance time of air bubbles (seconds). The results of this measurement are also shown in Table 1.

As clearly shown in Table 1, respective observed times required for air bubbles to be disappeared were within 60 seconds for all of example compositions (1)–(6) of the present invention, and showed more desirable dearating performances compared with reference compositions (4)–(6).

As to reference compositions (1)–(3), although they exhibited excellent dearating performances, the current density after three days had passed were above 3000 $\mu A/cm^2$, and thus they were not of practical application.

In example compositions (1) and (2), and reference compositions (4)–(6), with a varying ratio of dodecylbenzene, i.e., the organic compound in the electrically insulating solution, a change in the dearating performance was measured with respect to each composition from the disappearance time of air bubbles (seconds), and the dearating performance of each composition was evaluated. The results of this measurement are also shown in FIG. 1. As clearly from FIG. 1, it was discovered from the experiments that when the organic compound content exceeds 30%, reference compositions (4)–(6) were of fairly low quality with regard to the dearating performance.

Each composition was set in a rotational viscometer with coaxial electric field, and the shear stress (initial value) and the current density (initial value) flowing when generating the shear stress were measured when an AC external electric field of 5000 V/mm (frequency: 50 Hz) was applied under the conditions of a clearance between the cup and bob: 1.0 mm, a shear rate: 400/s; and temperature: 25° C. The results of these measurements were shown in Table 2.

Further, under an applied AC external electric field of 5000 V/mm (frequency: 50 Hz), the viscometer was kept driven at 25° C. for three days, and the shear stress and the current density were respectively measured after three days had passed, and the durability was measured for each composition. The results of measurements were also shown in Table 2.

Under an applied electric field of relatively low intensity, it is preferable that the electrorheological fluid has an excellent shear stress (a greater shear stress) and an excellent electric property (the smaller density of current flowing when the shear stress is induced). Especially, it is preferable that the composition are superior in both of the above properties.

As a parameter for determining a superiority or inferiority for evaluating the shear stress property and current property at one time, the ratio of the shear stress to current flowing at that time under an applied electric field of a constant intensity, i.e., shear stress value/current density value is effective. The ratio is hereinafter referred to as Z value.

From the results shown in Table 2, an initial Z value and the Z value after 3 days were respectively computed. The results of these measurements were also shown in Table 2.

TABLE 2

| | shear stress ($g/cm^2$) | | current density ($\mu A/cm^2$) | | Z value ($g/\mu A$) | |
|---|---|---|---|---|---|---|
| | initial value | 3 days value | initial value | 3 days value | initial value | 3 days value |
| Example Composition | | | | | | |
| (1) | 30 | 31 | 16 | 17 | 1.9 | 1.8 |
| (2) | 27 | 26 | 15 | 14 | 1.8 | 1.9 |
| (3) | 34 | 33 | 17 | 17 | 2.0 | 1.9 |
| (4) | 32 | 33 | 18 | 18 | 1.8 | 1.8 |
| (5) | 18 | 20 | 13 | 13 | 1.4 | 1.5 |
| (6) | 5 | 4 | 29 | 31 | 0.2 | 0.1 |
| Reference Composition | | | | | | |
| (1) | 35 | * | 20 | * | 1.8 | * |
| (2) | 36 | * | 21 | * | 1.7 | * |
| (3) | 19 | * | 20 | * | 1.0 | * |
| (4) | 25 | 25 | 17 | 18 | 1.5 | 1.4 |
| (5) | 23 | 22 | 15 | 15 | 1.5 | 1.5 |
| (6) | 21 | 21 | 13 | 13 | 1.6 | 1.6 |

In Table 2, * indicates that the current density became over 3000 $\mu A/cm^2$ and was not measurable after three days have passed.

As is clear from Table 2, the example compositions (1)–(6) in accordance with the present invention had superior electric properties, i.e., a greater shear stress and smaller current to the reference compositions (1)–(6) even under an applied electric field of relatively low intensity. Moreover, the example compositions (l)–(6) in accordance with the present invention had higher durability of the shear stress and of the current density compared with reference compositions (1)–(6).

The example compositions (1)–(4) in accordance with the present invention had initial Z values of 1.8 or above even after three days, and the balance between the shear stress and the current density were maintained for a long period of time, and thus the electrorheological fluid compositions in accordance with the present invention superior were found to to an electrorheological fluid composition of excellent durability.

The reference compositions (1)–(3) were inferior to any of the compositions of the present invention in terms of their durability of the shear stress and the current density.

The electrorheological fluid compositions using examples of other solid particles will be explained in reference to Examples 7–9.

Example 7

In the three-liter flask of Example 1, 1.2 litters of water were put, and 8 g of polyvinyl alcohol shown in Example 1 was dispersed. Thereafter, a mixture of 280 g of styrene, 20 g of industrial divinylbenzene of Example 1 and 5 g of azobisisobutyronitrile was added.

The contents in the flask were dispersed using the dispersing device at a stirring rate of 4000 rpm controlling the particle diameter and, thereafter were polymerized for 8 hours at 80° C. After the reaction had been completed, a solid material was obtained. Then, the solid material was filtered off and washed well with water and further dried for 12 hours at 80° C. using the hot air dryer. As a result, 291 g of spherical polymer (hereinafter referred to as polymer (4)) was obtained.

Then, the polymer (4) was sulfonated. First, 200 g of the polymer (4) was put into the 5-liter flask of example 1 and was was cooled off to 0° C. in the ice bath.

In the flask, 2500 g of fuming sulfuric acid was added, and a uniform dispersion solution was obtained. After stirring it for 12 hours in the ice bath, it was heated and stirred for three hours at 80° C. Then, a sulfonation was applied to the polymer (4). Thereafter, the reaction mixture was put in the water of 0° C., and the reaction mixture was filtered off and washed with water.

After the obtained solid material was neutralized with 1500 ml of 10% by weight of aqueous sodium hydroxide, the solid material was washed well with water. Thereafter, the solid material was dried for ten hours at 80° C. using a vacuum dryer, thereby obtaining 410 g of solid particles (4) composed of a spherical sulfonated polymer.

The solid particles were measured by the particle size analyzer, and was found to have an average particle diameter of 20 gm. The ion exchange content of the particles (4) was 5.5 mg eq./g by the neutral titration, and was 5.6 mg eq./g by the elemental analysis. The particles (4) have 2.4% by weight of moisture content as a result of measurement by a Karl Fischer moisture meter.

30 g of particles (4) were dispersed in 70 g of the mixed solution (1) prepared in Reference Example (1), and an electrorheological fluid composition (7) of the present invention was obtained.

Example 8

30 g of particles (4) were dispersed in 70 g of the mixed solution (3) prepared in Reference Example (3), and an electrorheological fluid composition (8) of the present invention was obtained.

Example 9

30 g of particles (4) were dispersed in 70 g of the mixed solution (4) prepared in Reference Example 4, and an electrorheological fluid composition (9) of the present invention was obtained.

Comparative Example 7

30 g of particles (4) were dispersed in 70 g of dimethylsilicone oil of Reference Example 1, and a reference electrorheological fluid composition (7) (hereinafter referred to as a reference composition (7)) was obtained.

Comparative Example 8

30 g of particles (4) were dispersed in 70 g of dimethylsilicone oil of Reference Example (3), and a reference electrorheological fluid composition (8) (hereinafter referred to as a reference composition (8)) was obtained.

Comparative Example 9

30 g of particles (4) were dispersed in 70 g of dimethylsilicone oil prepared in Reference Example 7, and a reference electrorheological fluid composition (9) (hereinafter referred to as a reference composition (9)) was obtained.

Results of experiments using the compositions (7)–(9) and the reference compositions (7)–(9) are explained below.

Each composition was set in a rotational viscometer with coaxial electric field, and a shear stress value (initial value) and the current density (initial value) flowing when generating the shear stress were measured when an AC external electric field of 5000 V/mm (frequency: 5 Hz) was under the conditions of clearance between the cup and hob: 1.0 mm, shear rate: 400/s; and temperature: 25° C. The results of these measurements are shown in Table 3.

Further, under an applied AC external electric field of 5000 V/mm (frequency: 5 Hz), the viscometer was kept driven at 25° C. for 14 days, and the shear stress and the current density were respectively measured after 14 days had passed, and the durability of the shear stress and of the current density were measured for each composition. The results of these measurements are also shown in Table 3.

From the results shown in Table 3, the initial Z value and the Z value after 14 days were measured. The results of measurements were also shown in Table 3.

TABLE 3

| | Viscosity (cP) | shear stress ($g/cm^2$) | | current density ($\mu A/cm^2$) | | Z value ($g/\mu A$) | |
|---|---|---|---|---|---|---|---|
| | | initial value | 14 days value | initial value | 14 days value | initial value | 14 days value |
| Example Composition | | | | | | | |
| (7) | 43 | 40 | 41 | 14 | 15 | 2.9 | 2.9 |
| (8) | 35 | 44 | 43 | 15 | 15 | 2.9 | 2.9 |
| (9) | 83 | 42 | 41 | 14 | 15 | 3.0 | 2.9 |
| Reference Composition | | | | | | | |
| (7) | 45 | 40 | * | 16 | * | 2.5 | * |
| (8) | 90 | 43 | * | 17 | * | 2.5 | * |
| (9) | 43 | 38 | * | 15 | * | 2.9 | * |

In Table 3, * indicates that the current density became over 3000 $\mu A/cm^2$ and was not measurable after 14 days have passed.

As is clear from Table 3, the compositions (7)–(9) of the present invention have superior properties to the reference compositions (7)–(9) even under an applied electric field of relatively low intensity, i.e., a greater shear stress and smaller current. Moreover, the compositions (7)–(9) of the present invention had higher durability of the shear stress and of the current density compared with reference compositions (7)–(9).

The compositions (7)–(9) of the present invention had initial Z values of 2.9 or above even after an elapsed of time of 14 days, and the balance between the shear stress and the current density was maintained for a long period of time, and thus the electrorheological fluid compositions of the present invention found to have high durability.

The reference compositions (7)–(9) were inferior to any of the compositions of the present invention in terms of their durability of the shear stress and the current density.

The inventors of the present invention disclose the disperse-phase particles formed of a sulfonated polymer, which shows a higher durability compared with the conventional disperse-phase particles, and are of use in practical applications. However, the inventors of the present invention discovered that discovered that the compositions (7)–(9) of the present invention showed still improved durability than the particles disclosed in U.S. Pat. No. 5,326,489.

Concerning the electrorheological fluid compositions in accordance with the present invention, examples of electrorheological fluid compositions to which addition agents were added will be explained. The examples of addition agents are shown in Reference Examples 10 and 11.

Reference Example 10

A 500 ml separable flask with four openings provided with an agitator, a reflux condenser, a thermometer and a nitrogen gas introducing tube was prepared. In the flask, 150 g of toluene, 1 g of azobisisobutyronitrile, 40 g of polydimethylsiloxane having a methacryloyl group (that has an average molecular weight=around 5000 and is Sairapurehn FM0721 and available from Chisso Corporation), and 60 g of dodecyl methacrylate were put. Then, while introducing thereto a nitrogen gas, the content in the flask was stirred for 30 minutes at room temperature. Then, the mixture was polymerized with an application of heat at 75° C. for three hours. After the reaction had been completed, the reaction solution was heated under a reduced pressure by an evaporator. Then, the volatile component of the reaction solution was taken out, thereby obtaining an oil-like polymer (5).

Another of the above flask was prepared. In the flask, 350 g of isopropyl alcohol, 2 g of the polymer (5), 1g of azobisisobutyronitrile and 50 g of styrene were added, to prepare the mixed solution was prepared. While introducing nitrogen gas in the mixed solution, the mixture was stirred for 30 minutes at room temperature and heated to 70° C. for 15 hours, and the polymerization was carried out using the mixed solution thus prepared.

To the resulting mixed solution, 200 g of silicone oil of Example 1 was dropped, and thereafter the solution was heated under a reduced pressure by evaporator so as to remove the volatile component from the solution, thereby obtaining a silicon oil dispersed solution of a composite (1). The dispersed solution includes 20% by weight of the composite (1). The dispersed solution thus prepared is hereinafter referred to as a dispersed solution (1).

In 5 g of the dispersed solution (1), 57 g of silicone oil of Reference Example 1 and 8 g of polybutene of Reference Example 6 were mixed, and 70 g of mixed solution (10) including the addition agent was prepared. The mixed solution (10) resulted in a viscosity of 20 cP.

Reference Example 11

In the 300 ml flask, 150 ml of methanol and 50 ml of deionized water were added, and 10 g of spherical silica powder (that has an average particle diameter of 1 $\mu$m, and is pearl in shape and available from Nippon Shokubai Co. Ltd.) was dispersed therein. Further, 5 g of γ-(methacryloxypropyl)trimethoxysilane was added, and the mixture was reacted for two hours at 40° C. Then, a methacryloyl group was introduced on the surface of the silica particle. Thereafter, the reaction solvent was taken out under a reduced pressure by an evaporator, and the reaction product was dried by a vacuum dryer at 50° C.

Next, 150 ml of toluene was put into a 200 ml flask, and 15 g of the reaction product was dispersed therein. Further, 0.1 g of azobisisobutyronitrile, 0.75 g of polydimethylsiloxane including a methacryloyl group of Reference Example 10 and 0.75 g of methoxy polyethylene glycol (that has a polymerization degree of polyethylene glycol: n=23, and an average molecular weight=1100, and is available from Shinnakamura Kagaku Kogyo k.k. NK ester M-230 G) were dissolved, and the mixture was heated for five hours at 70° C.

After 66 g of silicone oil of Reference Example 1 was dropped in the reaction solution, the volatile component was removed under a reduced pressure by the evaporator, and the silicone oil dispersed solution (2) of the composite (2) was obtained. The dispersed solution (2) contained 20% by weight of the composite (2).

70 g of mixed solution (11) including 7 g of dispersion solution (2), 53 g of silicone oil and 10 g of dodecylbenzene was prepared.

Example 10

30 g of particles (1) prepared in Example 1 were dispersed in 70 g of mixed solution (10) prepared in Reference Example 10, and an electrorheological fluid composition (10) of the present invention was obtained.

Example 11

30 g of particles (1) prepared in Example 1 were dispersed in 70 g of mixed solution (11) prepared in Reference Example 11, and electrorheological fluid composition (11) of the present invention was obtained.

The structural viscosity was measured for each of the compositions (10) and (11) and the reference composition (1) of Comparative Example 1.

For each composition, viscosities were measured at 25° C. without an electric field at shear rates of 3.3/s and 33/s. The results of this measurement were shown in Table 4. From the result, Ti value was computed through the following formula (10). Ti value is a parameter indicating the structural viscosity.

$$Ti=\eta_1-\eta_2 \quad (10)$$

In the formula (10), $\eta_1$ indicates a viscosity measured at a shear rate of 3.3/s and at 25° C. without an electric field, and $\eta_2$ indicates the viscosity measured at a shear rate of 33/s and at 25° C. without an electric field.

TABLE 4

| | Viscosity without Electric Field | | | Stability of Dispersion (mm) | | Redispersibility (times) |
|---|---|---|---|---|---|---|
| | $\eta_1$ (cP) | $\eta_2$ (cP) | Ti (cP) | 1 day value | 1 week value | 1 month value |
| Example Composition | | | | | | |
| (10) | 110 | 67 | 43 | 90 | 88 | 6 |
| (11) | 130 | 90 | 40 | 88 | 85 | 10 |
| Reference Composition | | | | | | |
| (1) | 47 | 45 | 2 | 35 | 35 | 60 |

Next, the dispersion stability of each composition was measured. The dispersion stability was measured in the following manner. Each composition was put in a test tube with a height of 150 mm and a diameter of 15 mm to the height of 100 mm, and the test tube was closed. Then, the test tube was left at room temperature, and the sedimentation state over time of the solid particle was observed. Then, the height of the sedimentation layer of the particles in the text tube was measured twice for each composition (after one day and after a week). The results of this measurement are also shown in Table 4. From the obtained stabilities against dispersion, the dispersion performances of the addition agents were evaluated.

Next, the respective abilities to be dispersed again (re-dispersibilities) after an time elapsed of one month were measured with respect to the compositions (10) and (11) and the reference composition (1) in the following manner.

30 ml of each composition was put into a 50 ml container and the container was closed. Then, after leaving it for one month, the container was rotated at a rotation speed of 30 times/minute, and the number of times required for restoring the original uniform condition was measured, and the re-dispersibility of each composition was evaluated. The results of this measurement were also shown in Table 4.

As described previously, the shear stress (initial value) and the current density (initial value) and the stability over time of the shear stress and the current density of each composition was also measured, and the results of this measurement are shown in Table 5.

TABLE 5

| | shear stress ($g/cm^2$) | | current density ($\mu A/cm^2$) | | Z value ($g/\mu A$) | |
|---|---|---|---|---|---|---|
| | initial value | 3 days value | initial value | 3 days value | initial value | 3 days value |
| Example Composition | | | | | | |
| (10) | 34 | 35 | 16 | 16 | 2.1 | 2.2 |
| (11) | 31 | 30 | 14 | 14 | 2.2 | 2.1 |
| Reference Composition | | | | | | |
| (1) | 35 | * | 20 | * | 1.8 | * |

In Table 5, * indicates that the current density became over 3000 $\mu A/cm^2$ and was not measurable after three days have passed.

As is clear from Table 4 and Table 5, the electrorheological fluids (10) and (11) of the present invention showed $\eta_2$ of not more than 500 cP and Ti of not less than 10 cP and not more than 500 cP, which indicate that the structural viscosity was formed in the fluids (10) and (11). Therefore, the respective compositions (10) and (11) resulted in an excellent dispersion stability, re-dispersibility and fluidity.

On the other hand, although the reference composition (1) resulted in $\eta_2$ of not more than 500 cP, it showed Ti of 2 cP. Therefore, the structural viscosity was not formed in the reference composition (1). Therefore, the reference composition (1) has an excellent fluidity, but has an inferior dispersion stability and ability to be dispersed again compared with the compositions (10) and (11) in accordance with the present invention.

Moreover, the compositions (10) and (11) in accordance with the present invention have the good shear stress property and the good current property the same as the reference composition (1) does, while they have higher durability of both the shear stress and the current density. Therefore, it was discovered that the compositions (10) and (11) in accordance with the present invention permit to ensure excellent shear stress and current for a long period of time.

The invention being thus described, it will be obvious that the same way be varied in many ways. Such variations are not to be regarded as a departure from the spirit and scope of the invention, and all such modifications as would be obvious to one skilled in the art are intended to be included within the scope of the following claims.

What is claimed is:

1. An electrorheological fluid composition comprising:

a dispersed phase composed of dielectric solid particles; and a dispersion medium composed of an electrically insulating solution, wherein said solution is composed of 95–75% by weight of silicone oil and 5–25% by weight of a hydrocarbon compound having at least one unsaturated bond, said hydrocarbon compound consisting of hydrogen and carbon and being at least one member selected from the group consisting of a long-chain alkene, a long-chain alkyl aromatic hydrocarbon, a long-chain alkene aromatic hydrocarbon, polybutadiene, a copolymer of styrene and ethylene, and a copolymer of styrene and propylene, and wherein the ratio of dielectric solid particles to the electrically insulating solution in the composition is 100 parts by weight to 50 to 500 parts by weight.

2. The electrorheological fluid composition as set forth in claim 1, wherein said solution has a viscosity at 25° C. in a range of 10–100 cP.

3. The electrorheological fluid composition as set forth in claim 1, said composition having a viscosity at 25° C. not more than 500 cP in an absence of an electric field.

4. The electrorheological fluid composition as set forth in claim 1, wherein said silicone oil includes polydimethylsiloxane.

5. The electrorheological fluid composition as set forth in claim 1, wherein said silicone oil has a viscosity at 25° C. in a range of 10–100 cP.

6. The electrorheological fluid composition as set forth in claim 1, wherein said hydrocarbon compound can be dissolved in said silicone oil.

7. The electrorheological fluid composition as set forth in claim 1, wherein said hydrocarbon compound is a long chain alkyl aromatic hydrocarbon.

8. The electrorheological fluid composition as set forth in claim 3, said composition having a structural viscosity satisfying a formula (1):

$$10\ cP \leqq \eta_1 - \eta_2 \leqq 500\ cP \quad (1)$$

wherein $\eta_1$ represents the viscosity at 25° C. and a shear rate of 3.3/s in the absence of an electric field, $\eta_2$ represents the viscosity at a temperature of 25° C. and a shear rate of 33/s in an absence of an electric field.

9. The electrorheological fluid composition as set forth in claim 1, further comprising an addition agent which improves a dispersion stability of said solid particles in said composition.

10. The electrorheological fluid composition as set forth in claim 9, wherein said addition agent is particulate in said solution, which satisfies a formula (2):

$$3/10 \leqq XB/XA < 3 \quad (2),$$

XA representing an average particle diameter of said addition agent and XB representing an average particle diameter of said solid particles.

11. The electrorheological fluid composition as set forth in claim 1, wherein said solid particles have an average diameter in a range of 0.05–100 micron.

12. The electrorheological fluid composition as set forth in claim 1, wherein said solid particles include an ionic dissociation group.

13. The electrorheological fluid composition as set forth in claim 12, wherein said ionic dissociation group is a sulfonic group.

14. The electrorheological fluid composition as set forth in claim 1, wherein said solid particles are semiconductor particles.

15. The electrorheological fluid composition as set forth in claim 1, wherein said solid particles respectively have an electrically insulating layer on surfaces of electrically conductive particles.

16. The electrorheological fluid composition as set forth in claim 1, wherein said solution is composed of 95–80% by weight of said silicone oil and 5–20% by weight of said hydrocarbon compound.

17. The electrorheological fluid composition as set forth in claim 1, wherein said hydrocarbon compound is an aromatic hydrocarbon compound.

18. An electrorheological fluid composition comprising:

a dispersed phase composed of dielectric solid particles;

a dispersion medium composed of an electrically insulating solution, wherein said solution is composed of 95–75% by weight of silicone oil and 5–25% by weight of a hydrocarbon compound having at least one unsaturated bond, said hydrocarbon compound consisting of hydrogen and carbon and being at least one member selected from the group consisting of a long-chain alkene, a long-chain alkyl aromatic hydrocarbon, a long-chain alkene aromatic hydrocarbon, polybutadiene, a copolymer of styrene and ethylene, and a copolymer of styrene and propylene; and an addition agent for providing improved dispersion stability of each solid particle and which is substantially insoluble to said solution, and wherein the ratio of dielectric solid particles to the electrically insulating solution in the composition is 100 parts by weight to 50 to 500 parts by weight.

* * * * *